United States Patent [19]

Anderson

[11] Patent Number: 4,984,654

[45] Date of Patent: Jan. 15, 1991

[54] SCAFFOLD SAFETY SYSTEM

[76] Inventor: Carl Anderson, c/o Alum-A-Pole Corporation 2589 Richmond Ter., Staten Island, N.Y. 10303

[21] Appl. No.: 521,573

[22] Filed: May 10, 1990

[51] Int. Cl.[5] ..... E04G 1/20; E04G 1/30

[52] U.S. Cl. ..... 182/179; 182/222; 403/227

[58] Field of Search ..... 182/179, 178, 222, 223; 403/227

[56] References Cited

U.S. PATENT DOCUMENTS

| | | | |
|---|---|---|---|
| 2,044,703 | 6/1936 | Kline | 182/179 |
| 3,222,974 | 12/1965 | Zink | 182/179 |
| 3,302,751 | 2/1967 | Ahlberg | 182/179 |
| 3,345,825 | 10/1967 | Parker | 182/179 |
| 3,613,831 | 10/1971 | Estep | 182/181 |
| 4,216,933 | 8/1980 | Cramer | 182/179 |
| 4,541,509 | 9/1985 | D'Alessio | 182/179 |
| 4,598,794 | 7/1986 | Anderson | 182/136 |
| 4,805,735 | 2/1989 | Anderson | 182/138 |
| 4,856,616 | 8/1989 | Anderson | 182/113 |
| 4,869,343 | 9/1989 | Anderson | 182/113 |

*Primary Examiner*—Reinaldo P. Machado
*Attorney, Agent, or Firm*—Helfgott & Karas

[57] ABSTRACT

A coupling arrangement for coupling a guard post to a scaffold platform. The couples includes a brace for attachment to the guard post. A plug member is carried by a portion of the brace and extends perpendicular to the post. The plug includes a resilient sleeve through which extends a bolt. The bolt passes externally of the brace for external manipulation thereof. The plug member is inserted into a hollow run of the scaffold. The bolt is tightened, whereby the sleeve becomes constructed and secures itself within the rung.

18 Claims, 3 Drawing Sheets

SCAFFOLD SAFETY SYSTEM

The invention relates to scaffold safety systems and more particularly to a module for coupling scaffold guarding means to scaffold platforms.

BACKGROUND OF THE INVENTION

In various industrial applications, scaffolding is erected in order to give workers access to elevations above ground. For example, in the installation of aluminum siding on the exterior of housing, scaffolding is required to enable workers to move up and down adjacent the side of the house. In such installation, the scaffolding is typically erected through the use of pump jack poles which are spaced apart alongside the house and secured to the house by means of braces. Pump jacks ride up and down on the poles and support a scaffold platform therebetween on which the workers stand. This scaffold platform typically comprises a pair of metal side rails, usually I-beam rails, held in parallel spaced relation by a plurality of spaced transverse hollow rungs upon which metal or wooden planks are placed and secured to provide the floor of the platform. These rungs may have a square cross-section to provide a plurality of flat upper surfaces in the same plane upon which the wooden planks may rest and be supported in place.

In order to protect the workers against falls, guarding means, such as guard rails or guard walls are erected from the scaffold platform on either or both sides of the workers. It is important that such guarding means be easy to assemble and attach to the platform and yet be firmly held in place without likelihood of detachment despite great outwardly applied pressure once assembled to the platform.

One such scaffold safety system is described and claimed in my U.S. Pat. No. 4,869,343. In accord with this scaffold safety system, one or more guard rail modules are erected along one or both sides of the platforms. Each guard rail module comprises a pair of spaced vertical guard posts connected by a horizontal hand rail. Each vertical post is retained by a coupling member which is clamped to a side rail of the platform. A planar panel may also be fastened to the post and handrail portions of each guard rail module to provide a guard wall therebetween.

The coupling member itself is described and claimed in my U.S. Pat. No. 4,856,616 and comprises an adjustable clamp having a pair of upper and lower lipped flange members which overlap the top and bottom flanges of an I-beam side rail of the scaffold platform. A fastening means passes through central web means of this adjustable clamp and bears against the outer side of this I-beam rail. A pair of apertures in the upper flange member of the clamp are shaped to receive and retain a pair of guard posts in side-by-side upright orientation.

Although this coupling member has been quite satisfactory for its intended purpose, it has been found that the alignment of the upper and lower flange members and the overlapping and clamping of these flange members to the I-beam rail is somewhat cumbersome and time consuming. In addition, the separate components of the coupling member may become lost or misplaced, and there is also a danger that the guard rail posts may accidentally be lifted out of their retaining apertures, or otherwise become separated from the coupling member, during use.

Accordingly, it is an object of the invention to provide a system for coupling a guarding means to a scaffold platform by which the coupling may be quickly and easily accomplished.

Another object of the invention is to provide a scaffold safety, system in which guard posts may be quickly and firmly coupled to a scaffold platform without danger that the posts may become separated from the coupling means.

A further object of the invention is to provide means for coupling guard posts to a scaffold platform in a manner which positively and securely retains the guard post in vertical orientation despite great pressure applied to the post in a direction away from the platform.

In another type of scaffolding arrangement, shown in my U.S. Pat. No. 4,805,618, upper and lower scaffold platforms traverse the spaced apart pump jack poles in opposite directions from a plane defined by the poles. The safety system shown in this patent includes a net wall which spans the gap between the upper and lower platforms. A plurality of individual clamps serve to attach the upper edge of the net wall to the upper platform and the lower edge of the net wall to the lower platform. This net wall not only protects the workers against falls, but also functions to catch and prevent tools and materials from falling to the ground below. However, it is somewhat inconvenient and time consuming to attach this net wall to these platforms by this plurality of clamps while standing on the lower platform.

Accordingly, it is a still further object of the invention to provide guard post coupling means which may be used to quickly and firmly attach a guard post to a scaffold platform in either vertical or horizontal orientation relative to the platform. The upper and lower edges of the net wall may then be preassembled to guard posts which may thereafter be quickly attached with horizontal orientation to the upper and lower platforms by workers standing on the lower platform.

SUMMARY OF THE INVENTION

Generally, in accordance with the invention, scaffold guarding means are provided for use with a scaffold of the type having a pair of side rails maintained in parallel spaced relation by a plurality of spaced hollow transverse rungs extending through and secured to the side rails. The scaffold guarding means includes a guard post module comprising a post, preferably made of aluminum, and a coupling means attached to the post for coupling the post to the scaffold platform. This coupling means is designed to take advantage of the passageway provided within the hollow transverse rungs of the platform and includes a bracing member, preferably also made of aluminum, and an elongated plug member having one end held by and extending from the bracing member perpendicular to the post. The other free end of the plug member is adapted to be inserted as a loose fit within any of the hollow rungs of the scaffold platform. The bracing member abuts the outer surface of the scaffold side rail when the plug member is fully inserted within a hollow rung of the platform.

The plug member includes means for constricting a resilient portion thereof in order to clamp the plug member within the platform rung. More specifically, the plug member comprises an elongated resilient sleeve, preferably of hard rubber, and contains means within the sleeve operable externally of the bracing member for constricting and contracting the sleeve axially and longitudinally so that the sleeve is simultaneously bent outwardly and expanded transversely to clamp against the inner wall of the rung within which it has been inserted, and thereby firmly couple the post to the platform. The guard module may thereafter be decoupled from the platform by merely releasing the sleeve constricting means to allow the resilient sleeve to return to its original unconstricted condition.

The resilient sleeve is constructed to have the same general cross-sectional shape as the inner surface of the hollow rung in order to enhance this clamping action. Preferably, both have a rectangular or square cross-section to inhibit rotation of the sleeve.

In order to protect workers standing on a scaffold platform, two or more such guard post modules are coupled through one or both platform side rails to spaced apart rungs of the platform with vertical orientation of the posts above the platform, and a handrail is connected between the spaced posts on the same side of the platform. For even greater protection, a guard wall may be connected to and between the spaced posts.

If the scaffold system comprises upper and lower scaffold platforms extending in opposite directions from the plane of the pump jack poles, guard post modules may also be respectively coupled to the two platforms with horizontal orientation of the posts alongside the side rails of the platforms which are located adjacent the plane of the pump jack poles. A net wall may be fastened to and between these horizontally oriented posts either before or after the guard post modules are coupled to the upper and lower platforms. For this specific use, coupling means may be attached to both ends of each post so that the post may be supported at both ends by coupling to the platform. In this embodiment, the distance between the plug members of the two end connected coupling means can be made equal to the distance between two spaced lengths of the platform which, in turn, is generally equal to the desired length of the net wall.

DETAILED DESCRIPTION OF THE INVENTION

Figure 1:
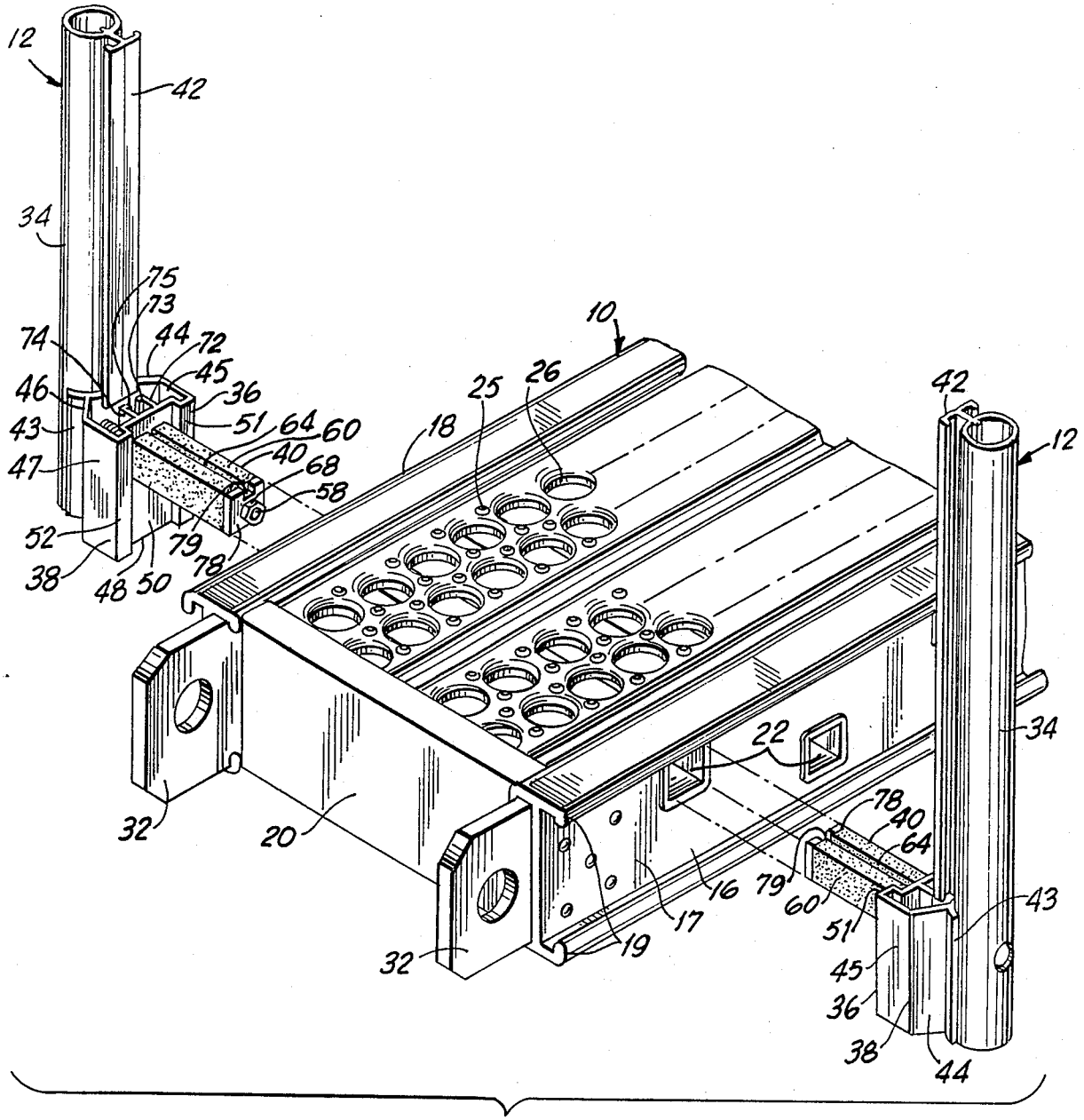
Figure 2:
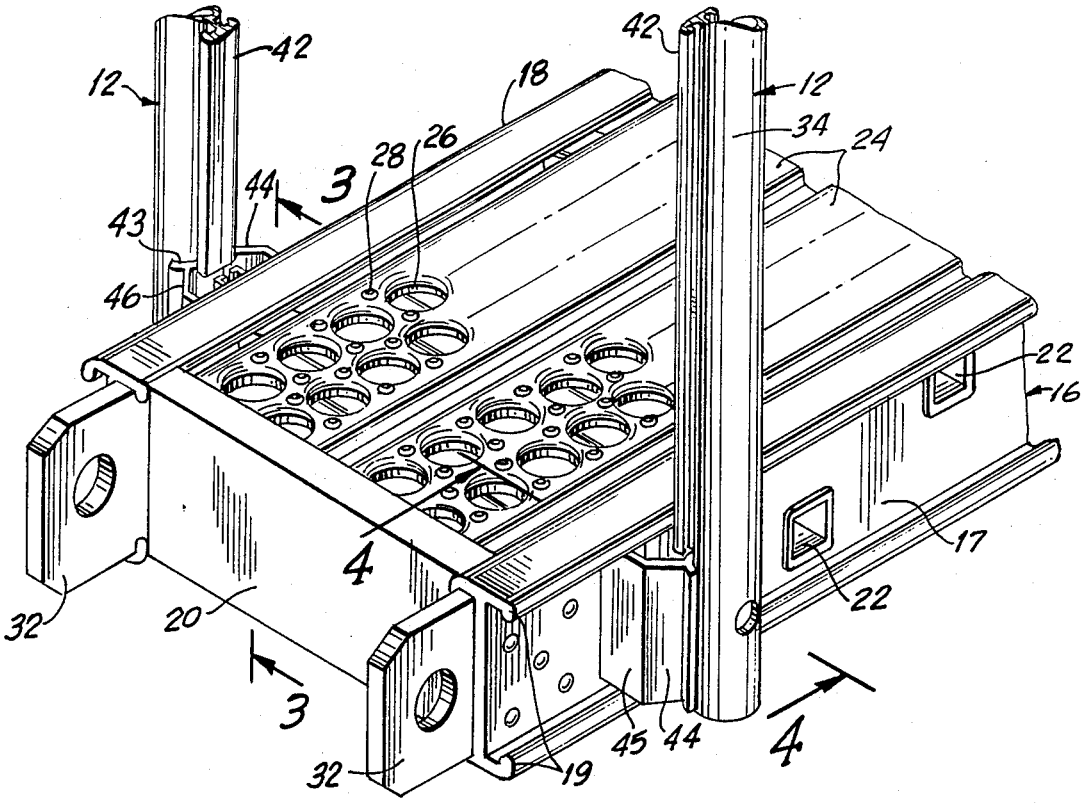
Figure 3:
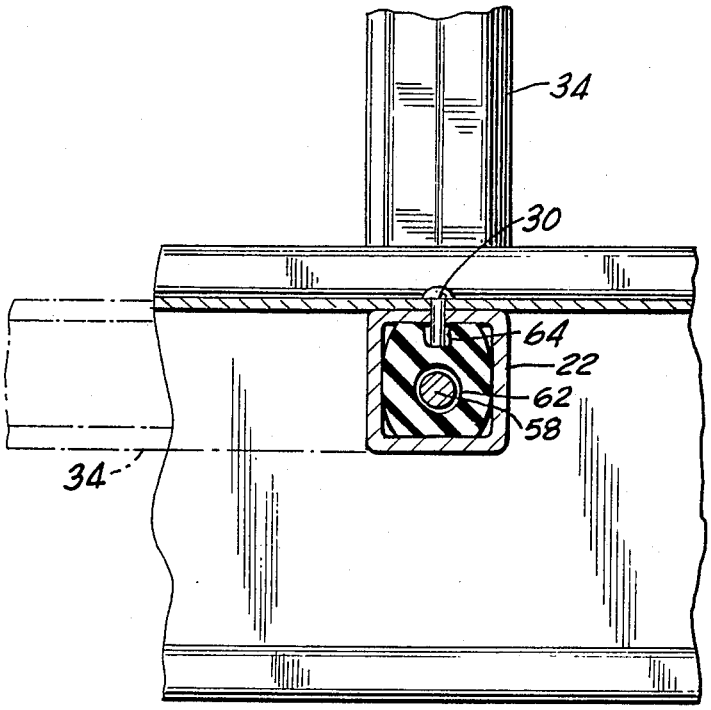
Figure 4:
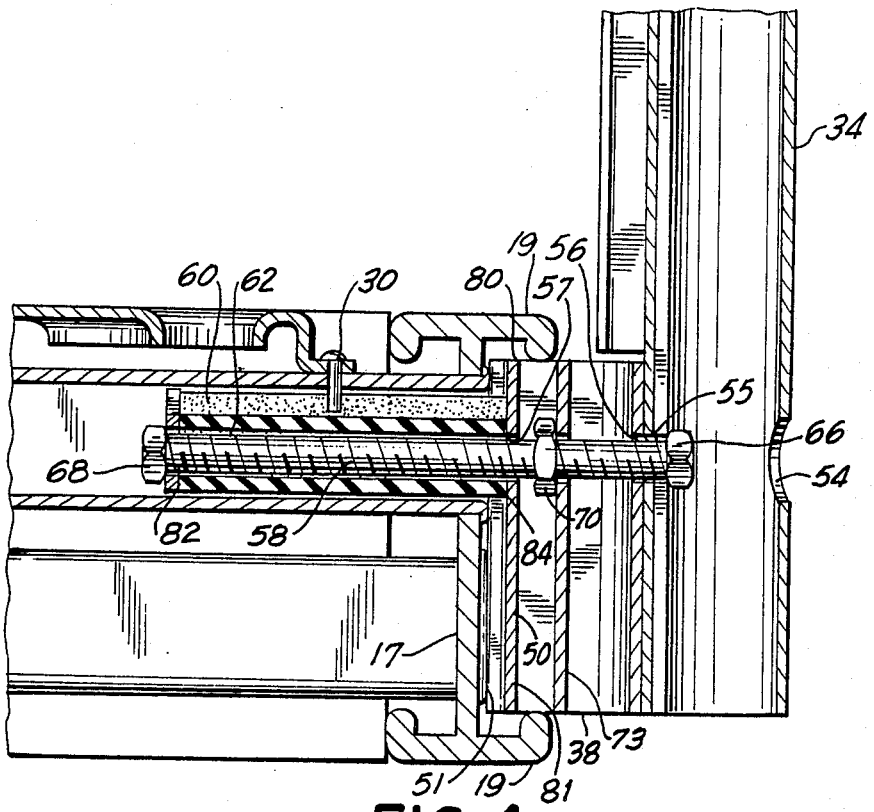
Figure 5:
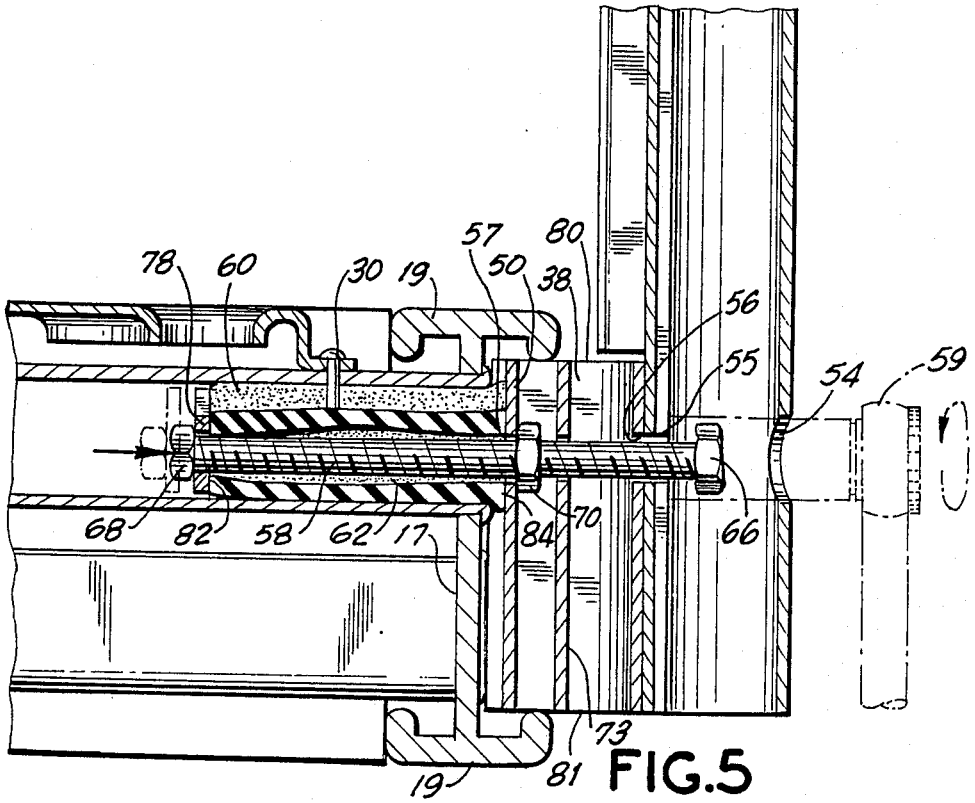

The novel features of the invention are set forth in the appended claims. The invention itself, together with further objects and advantages thereof, may best be understood by reference to the following description taken in conjunction with the accompanying drawings in which:

FIG. 1 is a perspective view of one end portion of a horizontal scaffold platform together with a pair of guard post modules arranged to be coupled with vertical post orientation to a rung of the platform through opposite sides of the platform, FIG. 2 is a perspective view corresponding to that of FIG. 1 but with the two guard post modules fully coupled to the opposite sides of the scaffold platform within the platform rung, FIG. 3 is a cross-sectional view, taken along line 3—3 of FIG. 2, showing the plug member of the coupling means in transversely expanded coupled condition, FIG. 4 a sectional view, taken along line 4—4 of FIG. 2 showing the plug member of the coupling means fully inserted within a rung of the platform with its resilient sleeve in its normal uncontracted and uncoupled condition, and FIG. 5 is a sectional view corresponding to that of FIG. 4 but with its resilient sleeve in its longitudinally contracted and fully coupled condition.

DESCRIPTION OF THE PREFERRED EMBODIMENT

Referring to FIG. 1 of the drawings, there is shown one end portion of a scaffold platform 10 and two guard post modules 12 arranged with vertical post orientation for coupling to platform 10. Platform 10 has a pair of metal side rails 16, 18 maintained in parallel spaced relation to one another by a pair of transverse end plates 20 (only one shown), and a plurality of transverse spaced hollow rungs 22, preferably of square cross-section. Side rails 16, 18 each have a central flat plate region 17 with overhanging edge flanges 19, thereby forming an I-beam. Rungs 22 pass through corresponding square holes in the web region 17 of each side rail so that the hollow central region of the rung constitutes a passageway open and accessible from both sides of the platform. Preferably, the opposite ends of each rung are also secured, such as by welding, to the side rails 16, 18. Successively spaced rungs are preferably connected to the side rails adjacent a different one of the two edge flanges, as shown.

The floor of platform 10 is shown as a pair of side-by-side metal planks 24 which rest upon the upper flat surfaces of alternately spaced rungs 22 which are located adjacent the upper edge flanges of the side rail. It will be appreciated that if the platform were turned over, the alternately spaced rungs which are now shown as being located adjacent the lower edge flanges would be used to support the floor planks.

The surface of the floor planks also typically contain a pattern of fairly large holes 26 and smaller holes 22 to provide a gripping surface for the workers walking along the platform. The small holes also accommodate rivets 30, best seen in FIGS. 3, 4, and 5, for fastening the planks 24 to the metal rungs 22. A pair of metal connector plates or ears 32 are respectively secured to the ends of the side rails to facilitate end-to-end connection of additional platforms.

The guard post modules 12 each comprises a post 34 and coupling means 36 secured to one end of the post for coupling post 34 to the platform 10. Coupling means 36 includes a bracing member 38, and a plug member 40 extending perpendicular to post 34 for insertion within hollow metal rungs 22.

Post 34 is shown as an elongated metal tube but may, of course, be a solid post. A connector rail 42 of T-shaped cross-section is secured to and along post 34 at the base of the T in order to facilitate connection to a guard wall. Connector rail 42 is preferably located along the side of post 34 destined to face platform 10 when the guard post module is coupled thereto. With this location, the rail 42 terminates at the bracing member 38.

Referring to FIGS. 1, 2, 4 and 5, bracing member 38 comprises a single metal strip, bent, shaped or extruded to form a closed loop which terminates in a semicircular concave base region 43 which conforms to, and is welded or otherwise fastened to, the convex external surface of the bottom end region of post 34. More specifically, bracing member 38 has a pair of outwardly flared flat side leg regions 44, 46, a pair of parallel flat side leg regions 45, 47 and a central web region 48. Web region 48 has a flat central portion 50 terminating in two flat projecting shoulder portions 51, 52, best seen in FIG. 1, located between the web region 48 and the two side leg regions 45, 47.

The height of bracing member 38, is made slightly less than the distance between the top and bottom flanges of the platform I-beam side rails so that the bracing member fits snugly between these flanges when the guard post module is coupled to the platform. When thus coupled, the projecting shoulder portions 51, 52 of this bracing member abut the central flat region 17 of the platform side rail to which it is coupled.

As best shown in FIGS. 4 and 5, post 34 and bracing member 38 have registering holes 54, 55, in post 34 and registering holes 56, 57 in the base and web regions of the bracing member 38, all of these holes being aligned to one another in a direction perpendicular to the post 34.

The plug member 40 includes a resilient sleeve 60 and means for constricting sleeve 60 comprising a long threaded bolt 58 which passes through aligned holes 55, 56 and 57 and extends externally considerably beyond the web region of bracing member 38. The diameter of holes 55, 56 and 57 is slightly larger than the diameter of bolt 58, thereby to accommodate bolt 58 as a loose fit therethrough, and yet firmly hold bolt 58 in a direction perpendicular to post 34. The diameter of hole 54 in post 34 is made larger than holes 55, 56 and 57 in order to accommodate a tool, such as a socket wrench 59, capable of turning bolt 58. A resilient elongated sleeve 60, preferably of moderately hard rubber such as used in tires, is mounted on the external portion of this bolt by means of an axial bore 62 whose diameter is likewise slightly larger than the diameter of bolt 58. Bolt 58 is thus able to move freely through and within holes 55, 56 and 57 and bore 62. The cross-sectional dimensions of sleeve 60 are slightly less than those of the inner wall of rung 22. Preferably, the amount of play between the outer sides of sleeve 60 and the corresponding inner walls of rung 22 is made to be less than 0.04 inches. Sleeve 60 also has a channel 64 of U-shaped cross-section extending the entire length of its upper surface in order to accommodate the portion of plank-fastening rivet 30 which protrudes through the upper surface of rung 22 when plug member 40 is inserted within rung 22. The positioning of the rivet in the channel serves to prevent rotation of the sleeve as the bolt is turned.

In order to be able to constrict and release the resilient sleeve 60 of plug member 40 from a position external to the guard post module 12, the opposite ends of bolt 58 each have a head or nut 66 and 68 firmly secured to the bolt end. A square metal member such as washer 78 is also located on bolt 58 between the free end of resilient sleeve 60 and the end nut 68. This washer 78 has a groove in its upper surface which matches the channel 64 in resilient sleeve 60.

A third hexagonal nut 70 is threaded on the bolt 58 and located in the region of the bolt immediately adjacent the central portion 50 of web region 48 of bracing member 38. This nut 70 is maintained in this general location and restrained against rotation by a pair of parallel metal strips 72, 74, best shown in FIG. 1, which extend across the height of this bracing member web region 48 on either side of nut 70 and in close proximity to two opposites sides of this nut 70. These two strips 72, 74 also each have a flange 73, 75 extending along its edge facing one another but with a space between these flange edges slightly larger than the diameter of bolt 58. Strips 72, 74 thus allow bolt 58 to move horizontally therebetween but form a channel 76 which restrains the nut 70 against rotation and simultaneously, because of these edge flanges, limits the horizontal movement of nut 70 to the width of the metal strips 72, 74. The length of bolt 58 is made long enough to accommodate sleeve 60 and also to extend beyond nut 70 into the interior of the hollow post 34. For example, bolt 58 may have an overall length of about 7 inches with about 4.5 inches extending externally beyond web region 48 of bracing member 38 to accommodate a sleeve 60 about 4 inches long.

In order to assemble the plug member 40 within the bracing member 38 of coupling means 36, bolt 58 is used before one end nut 68 has yet been secured to the end of bolt 58. Nut 70 is first held within the channel 76 aligned with hole 57 in web region 48 of bracing member 38, and a major portion of the body of bolt 58 is threaded within and through this nut 70 to extend externally of the bracing member. The resilient sleeve 60 and metal washer 78 are then inserted over this external portion of bolt 58, and nut 68 is then threaded and secured, such as by welding, to the bolt end.

In order to couple the guard post module 12 to scaffold 10, the bolt 58 is turned clockwise by means of tool 59, thereby causing a greater portion of bolt 58 to move externally beyond the web of the bracing member. This movement is caused by the non-rotation and confinement of nut 70 within the channel 76 provided by strips 72, 74 of the bracing member. The result of such movement of bolt 58 is shown in FIG. 4 with the distance between the end nut 68 and the central web potion 50 of bracing member 38 being greater than the length of sleeve 60. Sleeve 60 is thus in its natural unconstricted condition in which its cross-sectional dimensions throughout its length are slightly less than those of the inner walls of rung 22 so that sleeve 60 may be inserted as a loose fit within rung 22.

In its fully inserted position, the projecting strip portions 51, 52 of the web region 48 of bracing member 38 abut the central plate region of one of the platform side rails 16, 18, and the upper and lower edges 80, 81 of bracing member 38 fit snugly between the overhanging flanges of the side rail. Post 34 is thus firmly held against vertical movement and against rotational movement in the plane of the plug member perpendicular to the platform by the location of plug member 40 within rung 22 and by the interaction of bracing member 38 against the central plate and end flanges of the platform side rail.

The coupling of the guard post module 12 to the scaffold platform is then completed by merely rotating bolt 58 counterclockwise by tool 59 in order to clamp plug member within and against the inner walls of rung 22, as shown in FIGS. 3 and 5. This counterclockwise rotation of bolt 58 causes the distance between non-rotating nut 70 and outer end nut 68 to decrease until nut 70 first bears against the inner wall of the central portion 50 of bracing member web region 48. Then, as this counterclockwise rotation continues and this distance continues to decrease, end nut 68 causes an axial constriction of resilient sleeve 60 between washer 78 and the external surface of the bracing member central web portion 50. This axial constriction of sleeve 60 produces an outward bending and bulging of sleeve 60, particularly in its central region, as well as a transverse expansion of sleeve 60 so that the external surface of sleeve 60 presses tightly on all four sides against the inner wall of rung 22 substantially along the entire length of sleeve 60, and thereby firmly clamps plug member to and within rung 22. Since the sides of sleeve 60 are already close to the inner walls of rung 22, a constriction of less than 0.25 inches has been found to be sufficient to produce the desired clamping action.

This constriction of sleeve 60 also brings about a further axial clamping action between the opposite end surfaces 82,84 of sleeve 60 and the metal surfaces of washer 78 and the bracing member central web portion 50 located between the constricting nuts 68 and 70. This axial constriction of sleeve 60 helps prevent any radial rotation of post 34 around bolt 58 as an axis within a plane perpendicular to the platform.

In order thereafter to decouple guard post module 12 from platform 10, it is only necessary to rotate bolt 58 clockwise to lengthen the portion of bolt 58 between nuts 68 and 70 and allow sleeve 60 to return to its unconstricted natural condition, and then to remove plug member 40 from within rung 22.

It will be appreciated that with sleeve 60 in its unconstricted unclamped condition, bolt 58 is free to rotate within sleeve 60, and post 34 together with bracing member 38 may be pivoted into any radial position around bolt 58, including the vertical position shown in the drawings as well as a horizontal position alongside either of the side rails 14, 16 of the platform 10 as shown in dotted lines in FIG. 3. Plug member 40 may thus be inserted and clamped within rung 22 with post 34 in this horizontal position relative to platform 10 in the same manner as described above in connection with the vertical orientation of post 34. When the guard post module 12 is fully coupled to platform 10 in this horizontal position, the web region 48 of bracing member 38 will still abut the central plate region of a side rail 14, 16, but the bracing member 38 will be oriented horizontally with its side wall section 45, 47 extending parallel rather than perpendicular to the end flanges 19 of the platform side rail.

It will thus be seen that, in accord with the invention, there is provided a guard post module for a scaffold safety system that may be quickly and easily securely coupled to and decoupled from the scaffold platform with either vertical or horizontal orientation of the guard post. It is merely necessary to fully insert the plug member of the guard post within a rung of the platform with the guard post oriented vertically or horizontally, as desired, and then to turn a single bolt in one direction in order to couple the module to the platform. The guard post module may then be decoupled from the platform by merely turning this same bolt in the opposite direction to release and withdraw the plug member from within the platform rung. It should be appreciated that the direction of rotation of the bolt will depend upon whether it is a right hand or left hand bolt.

The type of material used for the sleeve can be any of various durable resilient materials such as EDPM rubber, rubber belting material, polyurethane or other yieldable elastomeric materials.

This guard post module may thus be used in either or both scaffold safety systems as shown in my U.S. Pat. Nos. 4,869,343 and 4,805,735. When used with vertical orientation of the guard posts in a safety system such as described in U.S. Pat. No. 4,869,343, at least two of the modules are coupled to spaced rungs of a same side of the platform with such vertical post orientation, and a guard rail and/or guard wall is connected between these two guard posts. When used with horizontal orientation of the guard posts in a safety system for upper and lower platforms such as in conjunction with a net system as in U.S. Pat. No. 4,805,735, each of two modules are coupled to a different one of the upper and lower platforms on the side of the platform adjacent the plane of the pump jack poles, and a net wall is connected between the horizontal posts of the two modules. When used with this latter system, the guard post may be made considerably longer than shown in the drawings to accommodate a net wall of corresponding length, and coupling means in accord with the invention provided at both ends of the guard post for coupling to spaced rungs on the same side of each platform.

While the invention has been described above in connection with a particular embodiment thereof, many modifications may be made, and it is intended by the appended claims to cover all such modifications as may be construed to fall within the scope of the invention claimed.

I claim:

1. A guard post module comprising a guard post and means for coupling said post to a scaffold platform comprising:

a bracing member attached to said post and a plug member carried by a portion of said bracing member and extending perpendicular to said post, said plug member having an external elongated resilient sleeve, said coupling means having means for axially constricting said sleeve to cause the dimensions of said sleeve to be transversely expanded, whereby said plug member may be inserted and clamped within a hollow rung of a scaffold platform.

2. The guard post module of claim 1 wherein said bracing member has a web region from which said plug member extends, said web region having at least one flat surface adjacent said plug member for bearing against a side rail of the platform to help brace said post when said plug member is fully inserted within a rung of the platform.

3. The guard post module of claim 2 for use with a scaffold platform having I-beam type side rails with overhanging top and bottom flanges, wherein said web region and said plug member carrying portion of said bracing member are dimensioned to fit snugly between the side rail top and bottom flanges when said plug member is fully inserted within a hollow rung of the platform.

4. The guard post module of claim 1 wherein said sleeve has an axial bore, and said constricting means comprises a bolt extending through said bore and having a metal member thereon bearing against one end of said sleeve, said bolt being at least partially supported by said bracing member and being rotatable to change the axial position of said metal member.

5. The guard post module of claim 4 wherein said sleeve extends between said bracing member and said metal member.

6. The guard post module of claim 5 wherein said bolt is a threaded bolt having a portion located within said bracing member and having a nut threaded on said bolt portion, said nut being maintained non-rotatable by said bracing member, whereby rotation of said bolt produces axial movement of said bolt to constrict and unconstrict said sleeve upon corresponding directional rotation of the bolt.

7. The guard post module of claim 4 wherein said sleeve has a rectangular cross section throughout its length in its unconstricted condition.

8. The guard post module of claim 7 wherein said axial bore of said sleeve has a diameter slightly larger than that of said bolt whereby said sleeve may be rotated on said bolt to enable said sleeve to be inserted within a rung of the platform with said post oriented either vertically or horizontally relative to said platform.

9. The guard post module of claim 1, wherein said sleeve is made of yieldable elastomeric material.

10. The guard post module of claim 9, wherein said sleeve is made of rubber material.

11. The guard post module of claim 9, wherein said sleeve is made of polyurethane material.

12. The guard post module of claim 8 wherein said post has a strip of T-shaped cross-section secured to a circular pole, said strip being secured at a base of the "T", said strip being for connection to a guard wall.

13. The guard post module of claim 7 wherein said post and bracing member have aligned holes within which said bolt is inserted, said holes having a diameter slightly larger than that of said bolt thereby to support said bolt for axial movement as a loose fit therein.

14. A scaffold safety system, comprising:

a scaffold platform having a pair of parallel side rails and a plurality of transverse hollow rungs extending through said side rails, and a guard post module, comprising:

a guard post, a plug member connected to and extending perpendicular to said guard post, said plug member having an elongated resilient sleeve adapted to be inserted as a clearance fit within at least one of said hollow rungs, and means operable externally of said post for axially constricting said sleeve within said one rung thereby to transversely expand and clamp said sleeve within said one rung.

15. The scaffold safety system of claim 14 wherein a bracing member is secured to said post between said post and said plug member, said bracing member having a flat surface which bears against one of said side rails when said plug member sleeve is fully inserted within said one rung.

16. The scaffold safety system of claim 14, wherein both said hollow one rung and said sleeve have similar rectangular cross-sections.

17. The scaffold safety system of claim 14, wherein said sleeve has an axial bore, and said sleeve constricting means comprises a bolt extending through said bore and having a metal member thereon bearing against one end of said sleeve, said bolt being axially movable in response to the rotation of said bolt.

18. The scaffold safety system of claim 14, wherein said sleeve is formed of yieldable elastomeric material.

* * * * *